US006378661B1

(12) United States Patent
Arabori et al.

(10) Patent No.: US 6,378,661 B1
(45) Date of Patent: Apr. 30, 2002

(54) ELEVATOR CONTROL SYSTEM HAVING AN IMMERSION PROOF STRUCTURE

(75) Inventors: Noboru Arabori, Yachiyo; Tadashi Ariki; Sanho Gon, both of Hitachinaka; Kazuo Ookawa, Ageo; Hiroki Shinozuka; Tomofumi Hagiya, both of Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/532,748

(22) Filed: Mar. 22, 2000

(30) Foreign Application Priority Data

Mar. 24, 1999 (JP) ..... 11-079182

(51) Int. Cl.[7] ..... B66B 1/00
(52) U.S. Cl. ..... 187/277; 187/391; 187/250
(58) Field of Search ..... 187/277, 351, 187/314, 333, 413, 414, 254, 266, 406, 250

(56) References Cited

U.S. PATENT DOCUMENTS 4,515,248 A * 5/1985 Ohta ..... 187/67
5,253,734 A * 10/1993 Laurutis ..... 187/6
5,271,483 A * 12/1993 Hong ..... 187/1 R
5,469,936 A * 11/1995 Lauga et al. ..... 187/205
6,148,962 A * 11/2000 Hakala et al. ..... 187/254
6,223,860 B1 * 5/2001 Nambe et al. ..... 187/277

FOREIGN PATENT DOCUMENTS

JP 2-276406 * 5/1992
JP 5-278966 * 5/1993
JP 8-231163 * 9/1996
JP 2000-159453 A * 6/2000
JP 2000-335843 A * 12/2000

* cited by examiner

*Primary Examiner*—Jonathan Salata
(74) *Attorney, Agent, or Firm*—Antonelli, Terry, Stout & Kraus, LLP

(57) ABSTRACT

An elevator control system which is installed in a pit of an elevator shaft in an elevator system is protected from flooding in the pit with the provision of an immersion proof structure for the control system. The elevator control system has a control device which can be installed in the pit of the elevator shaft so as to enhance the maintainability thereof since the necessity of a machine room can be eliminated from the elevator system. The immersion proof structure has a bag-like member which covers the control device and which has a top part opened for heat radiation from the elevator control device, the top part being located above the level of the floor of a lowermost one of stories of a building in which the elevator system is installed.

8 Claims, 2 Drawing Sheets

ELEVATOR CONTROL SYSTEM HAVING AN IMMERSION PROOF STRUCTURE

BACKGROUND OF THE INVENTION

1. Field of the Invention

The present invention relates to an elevator control system, and in particular, to an elevator control system for an elevator system in which a winding machine and an elevator control device in the control system are suitably installed in an elevator shaft.

RELATED ART

2. Description of the Related Art

Japanese Laid-Open Patent No. H4-15310 and Japanese Laid-Open Patent No. H8-231163 disclose an elevator control system which is arranged in an pit in an elevator shaft.

An elevator control system as is disclosed in the above-mentioned documents, is installed in an elevator shaft in order to eliminate the necessity of a machine room from an elevator system. However, for the control system which is usually installed in the pit of the elevator shaft, no countermeasure to cope with flooding in the pit of the elevator shaft has yet been made.

SUMMARY OF THE INVENTION

The present invention is devised in order to eliminate the above-mentioned drawbacks inherent to the conventional elevator control system.

Accordingly, one object of the present invention is to provide an elevator control system including an elevtator control device which can be installed in a pit within an elevator shaft and which can protect against flooding in the pit.

To the end according to the present invention, there is provided an elevator control system which is installed within a shaft, and which has a control device arranged in a pit below the level of the floor of a lowermost story, the elevator control device having an immersion proof structure.

BRIEF DESCRIPTION OF THE DRAWINGS

The present invention will be explained in detail in the form of a preferred embodiment with reference to the drawings in which.

DESCRIPTION TO THE PREFERRED EMBODIMENTS

Figure 1:
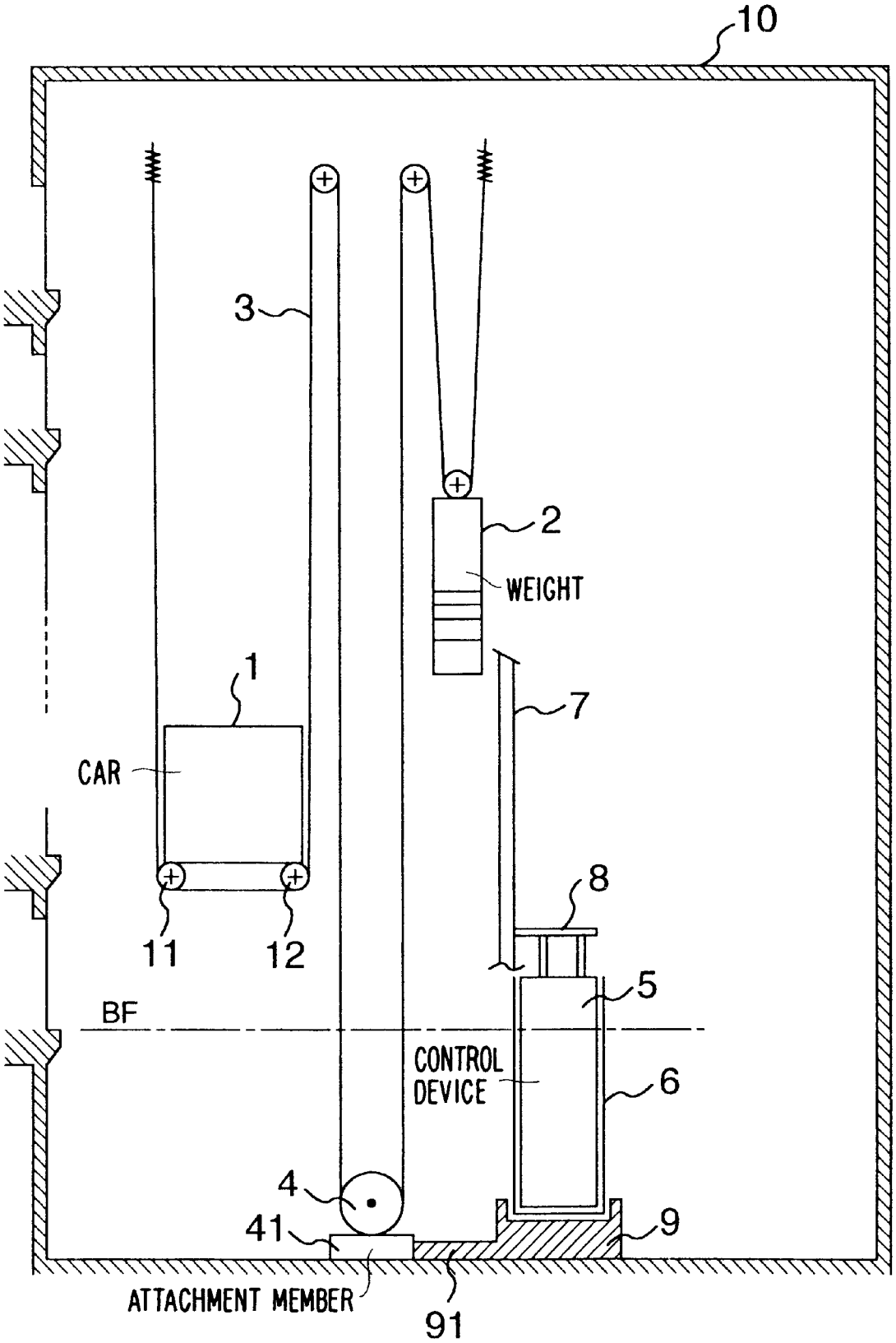
FIG. 1 is a schematic diagram view illustrating an elevator control system as a whole in an embodiment of the present invention.

Referring to FIG. 1 which shows an elevator system in an embodiment of the present invention. A car 1 in the elevator system is roped with a ratio of 2:1 by means of a balance weight 2 and a rope 3.

A gearless type winding machine composed of a permanent magnet type synchronous motor is used as a winding machine 4. A brake is provided in the winding machine. The car 1 is suspended by the rope 3 which runs pulleys 11, 12 provided underneath the car 1, that is, it is carried by the so-called under-slung manner. The reason why the permanent magnet type synchronous motor is used, is such that its motor efficiency is high, and it is small-sized. Further, why the gearless motor is used is such that it is silent so as to be suitable for the installation thereof within an elevator shaft 10, and accordingly, it is possible to restrain generation of noise as small as possible. Precisely, the winding machine 4 is installed in a pit in the elevator shaft 10, that is, it is located below the car in a vertical projection thereof. It should be noted that this figure is schematic and conceptual so that the planar positional relationship between the balance weight 2 and the winding machine 4 are not precise.

A control device 5 in the elevator control system is located in the pit within the elevator shaft 10, below the level BF of the floor of a lowermost one of stories for which the elevator system serves. In the case of installation of the winding machine 4 and the elevator control system in the elevator shaft 10, usually, it has to consider the countermeasure to cope with flooding in the pit due to rain water or the like. In this case, the winding machine may be simply designed to have an immersion proof structure. However, it is difficult to design the elevator control system having the control device 5 so as to have an immersion proof structure due to thermal problems. Further, it may be considered that the control device 5 is laid above the level BF of the floor of the lowermost story so as to be prevented from being submerged upon flooding in the pit.

However, since the depth of the pit is about 1.5 m in usual, when a maintenance person for the elevator services for the elevator control device 5 in the pit, the working efficiency becomes lower. In this embodiment, the control system 5 is installed in the pit, and is covered with a bag-like water-proof member 6 having its top part opened so as to cope with immersion due to flooding in the pit. In this arrangement, the water-proof member 6 is mounted so that the top part thereof is located above the level BF of the floor of the lowermost story. Accordingly, the control device 5 is projected upward, in part, from the level BF of the floor of the lowermost story. The upper part of the control device 5 is attached to a bracket 8 fixed to a rail 7, and the lower part thereof is fixed by a box-like member 9 which is mounted to an attachment member 41 for the winding machine 4 through the intermediary of a bracket 91.

Figure 2:
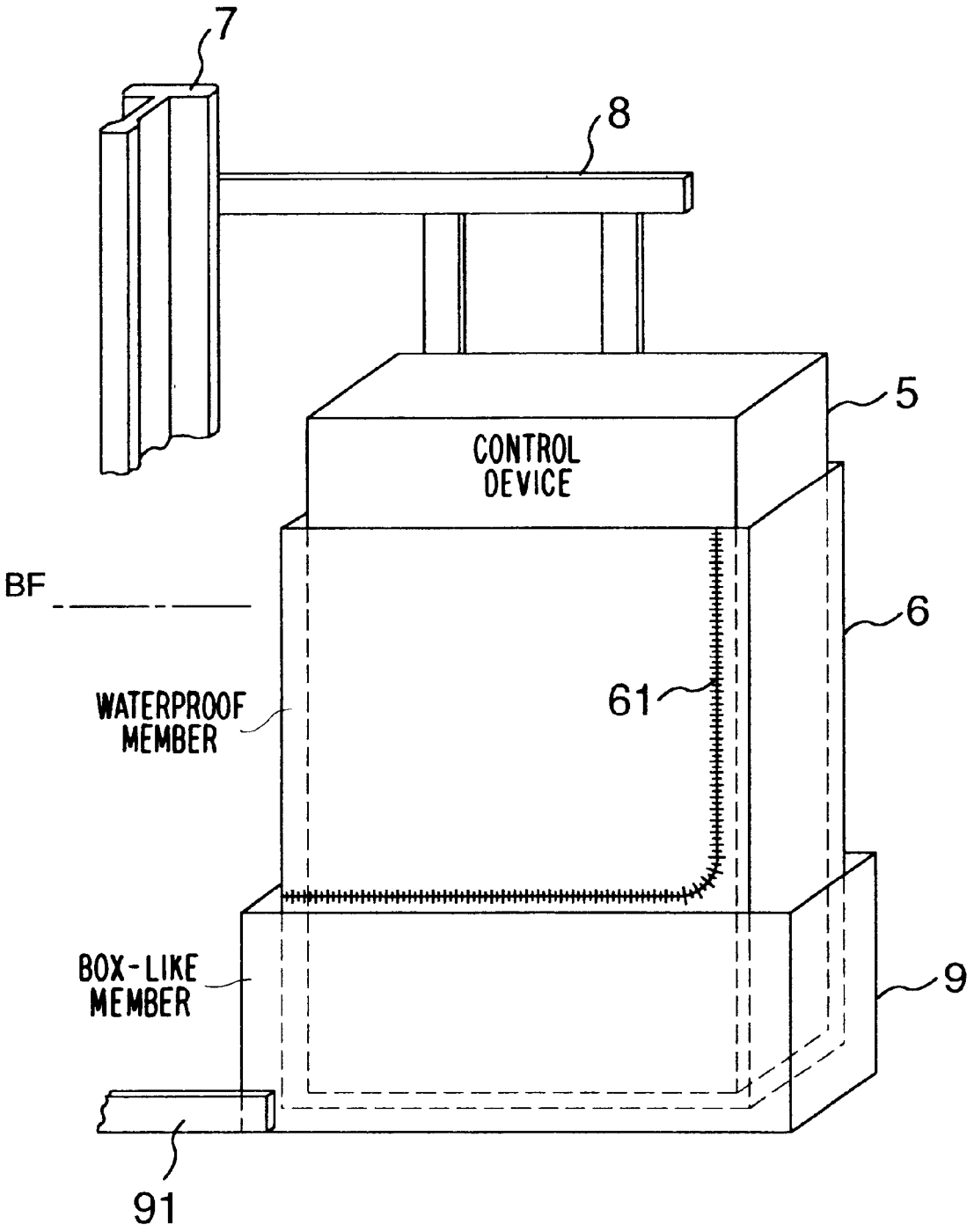
FIG. 2 is an enlarged perspective view illustrating a control device in the control system, which is installed in a pit of an elevator shaft in an embodiment of the present invention.

Referring to FIG. 2 which is an enlarged view illustrating a part of the elevator control device 5 in the embodiment of the present invention, the upper part of the control device 5 is attached to the bracket 8 projected from the rail 7 as mentioned above. In view of heat radiation from the control device 5, the control device 5 is covered with the bag-like water-proof member 6 which is extended from the bottom of the control device 5, and the top part of the bag-like water-proof member 6 is laid above the level BF of the floor of the lowermost story. Since the water-proof member 6 is thus arranged, effective countermeasure to cope with flooding in the pit can be taken. A water-proof type fastener 61 is provided to the bag-like water-proof member 6. With this arrangement, the maintenance and inspection for the elevator control device 5 can be easily made by opening the fastener 51. The water-proof member 6 and the control device 5 are fixed at their bottom parts by the box-like member 9 which is in turn fixed to the bracket 91 projected from the rail 7 or a fixing member 41 for the winding machine 4.

As stated above, since the control system has an immersion proof structure so as to provide the countermeasure to cope with flooding in the pit within the pit of the elevator shaft, and the elevator control device 5 can be installed in the pit of the elevator shaft, thereby it is possible to enhance the maintainability thereof.

Although the present invention has been explained hereinabove in the form of the preferred embodiment with reference to the drawing, the present invention should not be limited to the embodiment. It should be construed that various modifications and change can be made thereto without departing the spirit and the concept of the present invention.

What is claimed is:

1. An elevator control system comprising an elevator car for servicing several stories in a building through an elevator shaft, a winding machine installed in the elevator shaft, and a balance weight suspended in balance with said elevator car through the intermediary of the winding machine, rails for guiding said elevator car and the balance weight, respectively, and an elevator control system including a control device which is installed in the elevator shaft so that the control device is in part or in its entirety located below a level of a floor of the lowermost one of said several stories, and which has an immersion-proof structure composed of a bag-like member enclosing therein the control device and having an open top part.

2. An elevator control system comprising an elevator car for servicing several stories in a building having an elevator shaft which defines a pit in its bottom part, a winding machine installed in the elevator shaft, a balance weight suspended in balance with said elevator car, guide rails for guiding said elevator cars and said balance weight, and an elevator control system including a control device which is installed in said pit of the elevator shaft, and which has an immersion-proof structure composed of a bag-like member enclosing therein the control device and having an open top part.

3. An elevator control system as set forth in claim 1 or 2, wherein said bag-like member is incorporated with a fastener of a water-proof type.

4. An elevator control system as set forth in claims 1 or 2, wherein said elevator control device has an upper part which is fixed to said rail through the intermediary of an attaching means, and has a lower part which is fixed by a box-like member attached to an attaching member for said winding machine or the rail.

5. An elevator control system as set forth in claim 1 or 2, wherein the top part of the bag-like member is located above the level of the floor of the lowermost one of said several stories.

6. An elevator control system as set forth in claim 3, wherein said elevator control system has an upper part which is fixed to said rail through the intermediary of an attaching means, and has a lower part which is fixed by a box-like member attached to an attaching member for said winding machine or the rail.

7. An elevator control system as set forth in claim 3, wherein the top part of the bag-like member is located above the level of the floor of the lowermost one of said several stories.

8. An elevator control system as set forth in claim 4, wherein the top part of the bag-like member is located above the level of the floor of the lowermost one of said several stories.

* * * * *